United States Patent [19]

Fortsch

[11] Patent Number: 4,765,032

[45] Date of Patent: Aug. 23, 1988

[54] ENVIRONMENTAL BUNDLING TIE

[75] Inventor: William A. Fortsch, Bernardsville, N.J.

[73] Assignee: Thomas & Betts Corporation, Bridgewater, N.J.

[21] Appl. No.: 24,639

[22] Filed: Mar. 11, 1987

[51] Int. Cl.[4] ..... B65D 63/06

[52] U.S. Cl. ..... 24/23 R; 24/23 W; 24/25

[58] Field of Search ..... 24/20 R, 20 CW, 20 EE, 24/20 W, 21, 22, 23 R, 23 W, 23 EE, 25, 28, 616; 285/365, 407, 242

[56] References Cited

U.S. PATENT DOCUMENTS

| | | | |
|---|---|---|---|
| 19,709 | 3/1858 | Olmstead . | |
| 134,052 | 12/1872 | Gurley . | |
| 149,468 | 4/1874 | Goldsmith . | |
| 153,820 | 8/1874 | Goldsmith . | |
| 155,413 | 9/1874 | Boisseau | 24/21 |
| 175,546 | 3/1876 | Thayer . | |
| 184,650 | 11/1876 | Moore . | |
| 201,431 | 3/1878 | Logue . | |
| 903,128 | 11/1908 | Cary . | |
| 980,700 | 1/1911 | Swafford | 24/25 |
| 1,053,684 | 2/1913 | Vogel | 24/20 LS |
| 1,332,645 | 3/1920 | Turner | 24/21 |
| 2,273,007 | 2/1942 | Cooper | 24/23 W |
| 2,964,937 | 12/1960 | Lautin | 24/616 |
| 3,192,584 | 7/1965 | Pape | 24/23 W |
| 3,300,825 | 1/1967 | Andreasen | 24/25 |
| 3,311,957 | 4/1967 | Dunn | 24/21 |
| 3,530,544 | 9/1970 | Burniston | 24/16 |
| 3,587,142 | 6/1971 | Scaravelli | 24/268 |
| 3,694,863 | 10/1972 | Wasserlein, Jr. | 24/16 PB |
| 3,964,133 | 6/1976 | Wasserlein, Jr. | 24/23 R |
| 4,015,311 | 4/1977 | Curtis | 24/23 R |
| 4,128,919 | 12/1978 | Bulanda et al. | 24/20 |
| 4,366,602 | 1/1983 | Conlon et al. | 24/25 |
| 4,399,593 | 8/1983 | DeBradandere et al. | 24/25 |

FOREIGN PATENT DOCUMENTS

| | | | |
|---|---|---|---|
| 0206710 | 2/1984 | German Democratic Rep. | 24/23 R |
| 137072 | 12/1919 | United Kingdom | 24/25 |
| 137029 | 11/1920 | United Kingdom | 24/24 |

OTHER PUBLICATIONS

T&B Catalog No. 100.01, "Ty-Rap® Cable Tie and Fastening Systems", 31 pages, 1986, see p. 25.

Panduit Bulletin M-MLT-3, "Stainless Steel Clamps and Strapping", 11 pages.

Panduit Technical/Application Data Sheet TADS-C-T-16, "Selection and Use of PAN-STEEL TM Stainless Steel Ties and Identification Systems", 7 pages, 1982.

*Primary Examiner*—Victor N. Sakran

*Attorney, Agent, or Firm*—Robert M. Rodrick; Salvatore J. Abbruzzese

[57] ABSTRACT

Self-locking bundling ties for engagement about electrical cables, pipes or the like comprises a flat, metallic strap and a metallic head separably attached thereto. In the preferred form, the head is crimped to a folded-over end of the metallic strap. The head comprises a generally tubular housing with a generally planar locking insert slidably received in the housing cavity. The housing and insert include cooperative latching structure for holding the insert fixed in at least two positions relative to the housing. In a first position, the insert has an opening for receipt of the unattached end of the strap therethrough. Upon movement of the insert interiorly of the housing cavity to a second locked position, the insert opening with a portion of the strap end therethrough is moved interiorly of the housing and the strap end is deformed into a reverse bend to thereby lock the strap in the bundling tie head.

17 Claims, 5 Drawing Sheets

FIG. 5
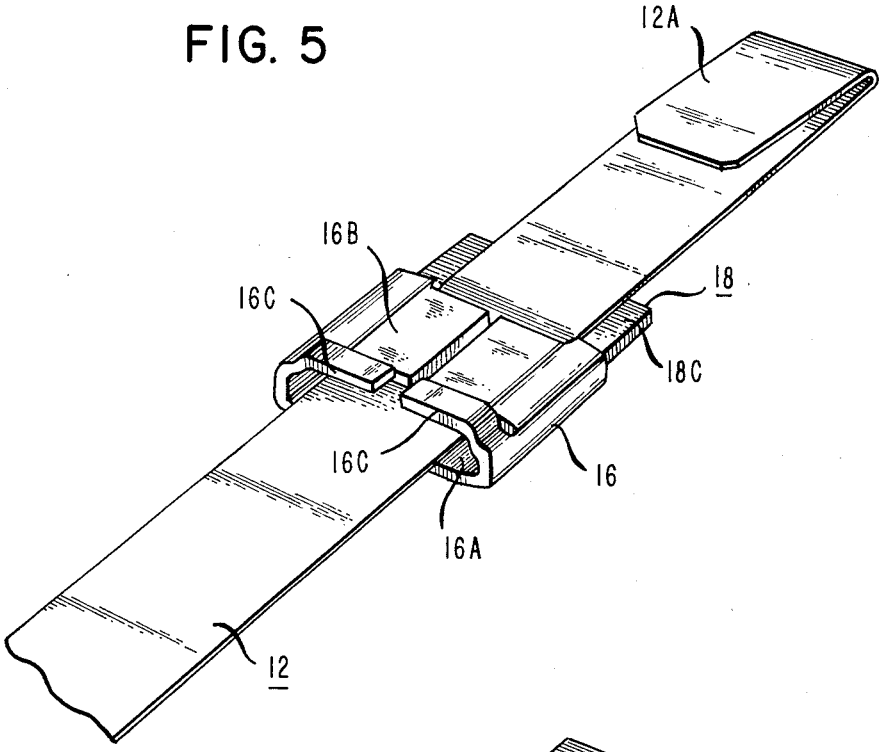
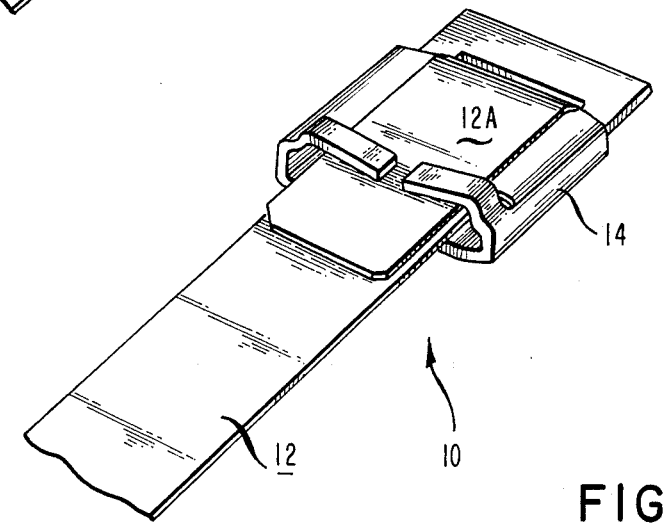
FIG. 1

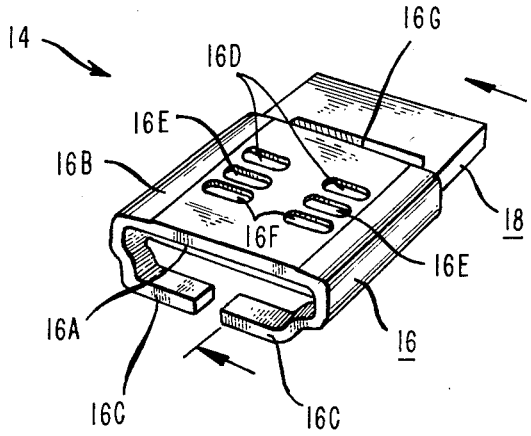
FIG. 2
FIG. 3
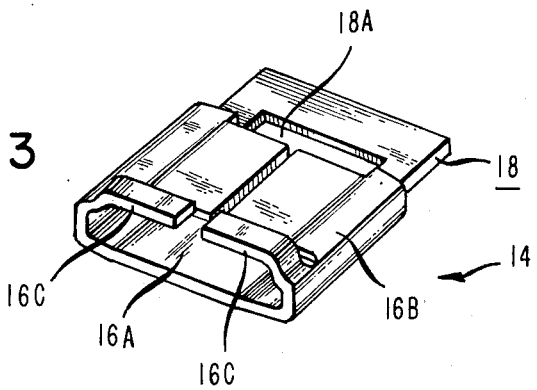
FIG. 4
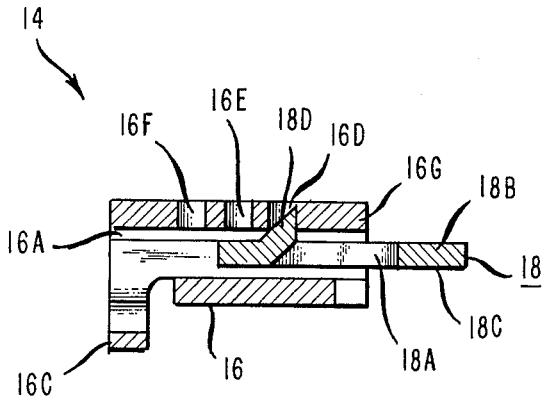

ENVIRONMENTAL BUNDLING TIE

FIELD OF THE INVENTION

This invention relates to a bundling tie and more particularly to a self-locking bundling tie for use in harsh environments.

BACKGROUND OF THE INVENTION

There is a need in industry and, in particular in environments where the conditions are adverse, such as in the telecommunications, marine and chemical plant environments for a bundling tie capable of standing-up to such environments. For example, such ties may be used to hold electrical cables, piping, or in duct work where temperature extremes may be severe and atmospheric conditions may contain corrosive elements.

In such environments, stainless steel bundling ties are in present use for their strength, longevity and ability to withstand the adverse environments. Bundling ties formed of stainless steel and other metals are shown for example in U.S. Pat. Nos. 4,366,602; 4,128,919; 3,311,957; 3,964,133; and 3,694,863. While these ties are capable of withstanding adverse environments, there is a need with some of these ties for the user to have a special tool to apply the bundling tie properly about a plurality of articles such as cables or pipes. Such tools may provide suitable tensioning to the strap and subsequent cutting after the suitable tension has been achieved. As a sharp edge commonly occurs as a result of the cutting of the strap, there is need to keep this sharp edge away from the user so as to prevent injury.

SUMMARY OF THE INVENTION

It is an object of the present invention to provide an improved bundling tie.

It is a further object of the present invention to provide an improved self-locking bundling tie that is useful in harsh, adverse environments.

In accordance with a preferred embodiment of the present invention, a self-locking bundling tie for engagement about an article comprises a flexible, elongate strap having two opposing longitudinal ends and a head attached to the strap adjacent one end thereof. The head includes a housing and a locking insert supported by the housing and movable relative thereto. The housing and the locking insert include cooperative latching means for holding the insert fixed in at least two positions relative to the housing. The insert in a first position has an opening for receipt of the unattached end of the strap therethrough, the housing and the insert cooperating upon movement of the insert to a second position to engage and deform a portion of the strap extending through the opening. In such condition, the strap is captured in a locked position relative to the bundling tie head.

In the particular form of the bundling tie, the head and the strap are separably attached and the head and strap are each formed of a metal, preferably stainless steel.

BRIEF DESCRIPTION OF THE DRAWINGS

FIG. 1 is a bottom perspective, partial view of the bundling tie of the present invention showing the bundling tie strap and head in assembled condition.

FIG. 2 is a top perspective view of the bundling tie head of the tie shown in FIG. 1.

FIG. 3 is a bottom perspective view of the bundling tie head of FIG. 2.

FIG. 4 is a cross-sectional view of the bundling tie head as seen along viewing lines IV—IV of FIG. 2.

FIG. 5 is a bottom perspective view of the bundling tie of FIG. 1 showing the tie strap and head in disassembled condition.

DETAILED DESCRIPTION OF THE PREFERRED EMBODIMENTS

Figure 6:
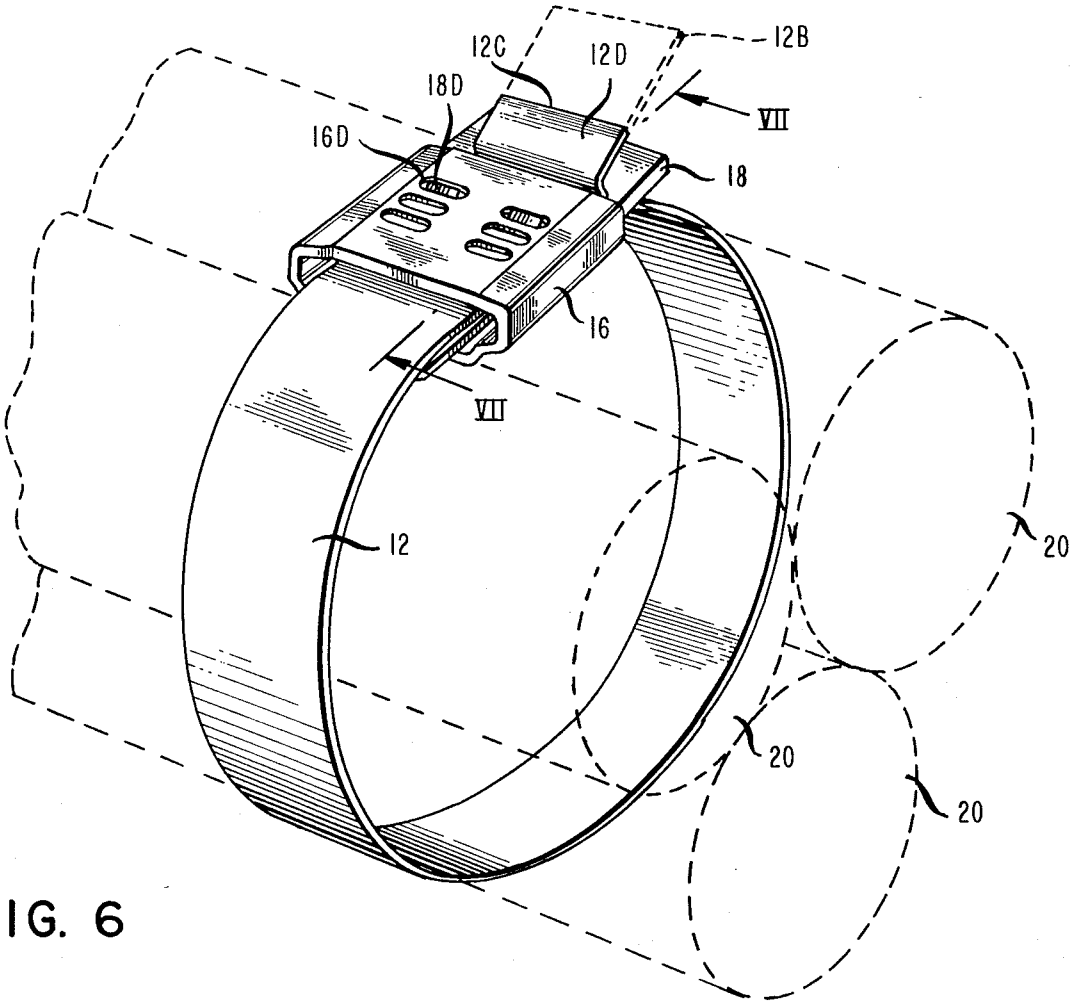
FIG. 6 is a perspective view of the bundling tie of the subject invention shown in application about a plurality of articles and prior to locking.

Referring now to the drawings figures, there is shown in FIG. 1 a bundling tie 10 in accordance with the subject invention. Tie 10 comprises an elongate, flexible flat strap 12 that is suitably attached at one end 12A thereof to a tie head 14. In the preferred form of the invention, the bundling tie strap 12 and head 14 are separably attached, the details of which will be described hereinafter, and the strap 12 and head 14 are both formed of a metallic material, in particular, stainless steel, for its strength and specific use in harsh environments.

Referring now to FIGS. 2, 3 and 4, the details of the bundling tie head 14 are more fully described. The bundling tie head 14 comprises a housing 16 and a locking insert 18, both, in the preferred form, being formed of stainless steel. The housing 16, formed of a generally tubular, hollow construction, has a cavity 16A extending fully through the walls 16B of the housing 16. The housing walls 16B are formed such that the cavity 16A has a generally rectangular shape. At the lower portior of the rear face of the housing 16, there extends a pair of deformable arms 16C, separably facing each other. At the upper portion of the housing 16, there are two rows of three recesses 16D, 16E and 16F spaced from each other and extending through the upper wall of the housing to communicate with the cavity 16A. However, any number of recesses may be utilized, with there being at least two recesses spaced differently from the front face 16G of the housing. In a preferred form, housing 16 may be made by a conventional stamping technique and folding the housing into the configuration as shown such that the walls 16B at the bottom thereof are slightly spaced as illustrated in FIG. 3.

Referring still to FIGS. 2, 3, and 4, insert 18 is formed as a generally planar, flat member. Insert 18 has an opening 18A extending through its upper and lower surfaces 18B and 18C, opening 18A being configured to receive the unattached end of the strap 12 therethrough, as will be described. Insert 18 is slidably received in the housing cavity 16A from the front face 16G of the housing 16. Insert 18 preferably has two laterally spaced barbs, 18D projecting upwardly from insert upper surface 18B. Barbs 18D are particularly configured to engage the housing recesses 16D, 16E and 16F, in a manner to retentively hold the insert 18 in a fixed position relative to the housing 16 when the barbs 18D are in each of the recesses 16D, 16E, and 16F. Barbs 18D are specifically formed such that insertion of the insert 18 into the cavity 16A is permitted while the cooperative latching between the barbs and the recesses in the housing prevents withdrawal of the insert 18. By further reference to FIG. 4, when the insert 18 is disposed in the housing 16, such that the barbs 18D are in the recess 16D closest to the front face 16G of the housing 16, insert opening 18A has a portion thereof lying exteriorly of the housing 16.

Turning now to FIG. 5 and also again to FIG. 1, the assembly of the bundling tie in accordance with the preferred construction is described. One end 12A of the bundling tie strap 12, which may be formed in predetermined lengths or cut to a suitable size by a user, is folded back over the remainder of the strap 12. The opposite end (not shown) of the strap 12 is then inserted through the housing cavity 16A against the lower surface 18C of the insert 18. The strap is inserted until the folded end 12A extends over the bottom walls of the housing and beneath the crimpable arms 16C in a manner as shown in FIG. 1. Upon seating the strap 12 in this position, a suitable tool such as a conventional pliers, is then used to deform the arms 16C in crimped fashion against the folded strap portion 12A to mechanically secure the head 14 and the strap 12 in attached condition.

Figure 7:
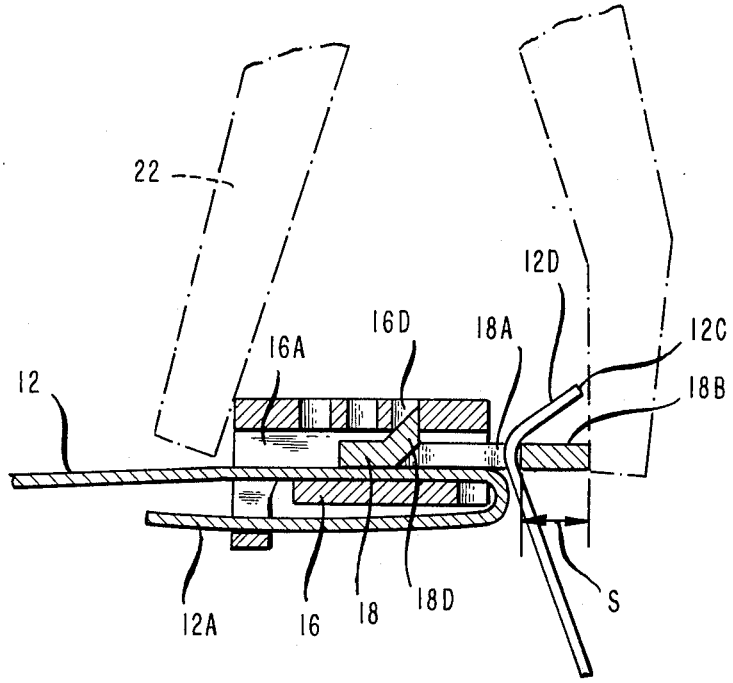
FIG. 7 is a cross-sectional view of the bundling tie head and strap as seen along viewing lines VII—VII of FIG. 6.

Turning now to FIGS. 6–9, the application of the bundling tie of the subject invention is set forth. As seen in FIGS. 6 and 7, the unattached end 12B of the strap 12 is encircled around a plurality of articles 20, such as electrical cables or pipes. The strap end 12B is fed through the insert opening 18A, opening 18A being accessible as the insert 18 is in a first position where the locking barbs 18D are latched in recesses 16D of the housing 16. Once extending through the opening 18A, the strap is pulled snugly about the articles 20 and end 12B is bent forwardly in a manner as shown in FIG. 6. Strap end 12B is then cut to provide a cut end 12C. The length of the extent 12D of the strap portion extending through the opening 18A above insert surface 18B is preferably less than the spacing S of the front end of the insert 18 as seen in FIG. 7.

Figure 9:
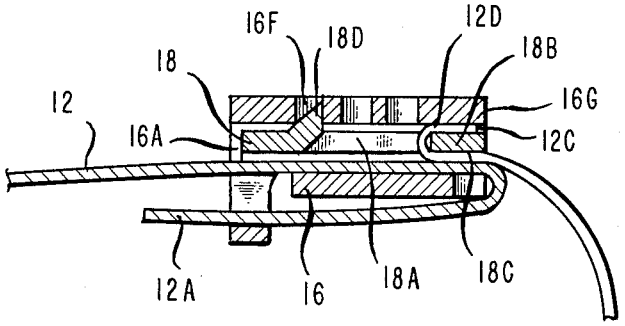
FIG. 9 is a cross-sectional view of the bundling tie head and strap as seen along viewing lines IX—IX of FIG. 8.
Figure 8:
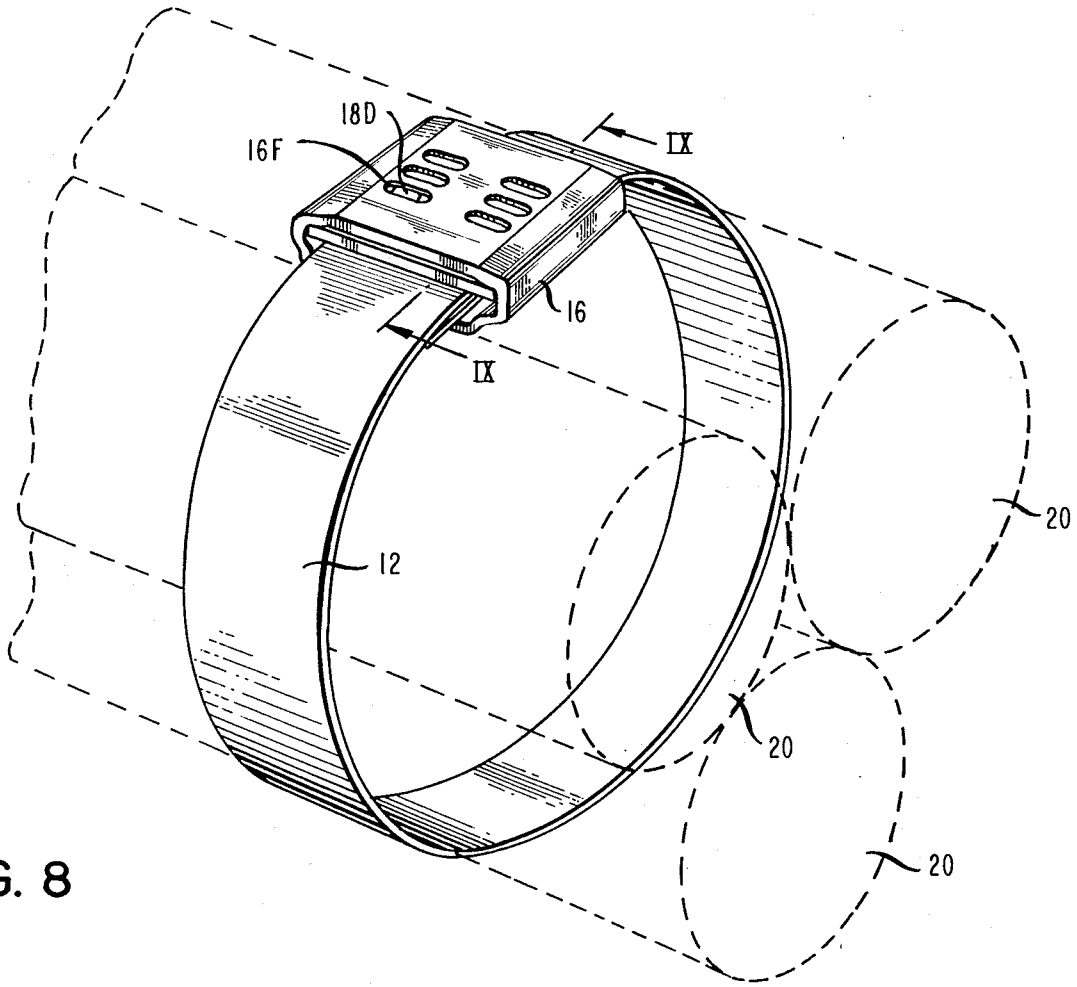
FIG. 8 is a view of the bundling tie of FIG. 6 as shown in locked condition.

Upon movably sliding the insert 18 inwardly in housing cavity 16A by a conventional tool such as pliers 22, the strap 12 is locked about the articles 20 as illustrated in FIGS. 8 and 9. Upon sliding the insert 18 into the cavity 16A, barbs 18D are moved from the first recesses 16D to one of the next recesses 16E or 16F, wherein insert 18 is locked thereat. As illustrated in the drawing figures, barbs 16D are situated in recesses 16F. During this movement, the opening 18A together with the end of the strap 12 therein are moved inwardly of the housing 16 in such a manner as to deform the strap in a reverse fold such that extent 12D lies adjacent insert surface 18B reversely from a portion of the strap 12 lying adjacent insert surface 18C. In this condition, the double bend of the strap end provides a secure locking arrangement in the bundling tie head. Furthermore, the movement of the locking insert 18 from the first recesses 16D to the third recesses 16F provides a further take-up or tightening of the strap 12 about the articles 20. In addition, the cut end 12C which may have a sharp edge is disposed interiorly of the housing and within the cavity 16A thereby locating end 12C in a manner to minimize potential injury to a user. While it is desirable that cut end 12C be disposed within housing 16, it should be understood that locating the cut end 12C closely adjacent the front face 16G of the housing will help to keep the cut end 12C away from the user.

Having described the preferred embodiment of the self-locking bundling tie of the present invention, the benefits and advantages thereof should be appreciated. For example, no special tools are required other than a conventional pair of pliers, any slack or looseness in the tie strap is tightened during the final locking stages upon movement of the locking insert, and sharp edges are disposed in a manner to minimize access to a user. It should also be appreciated that modifications or variations of the subject invention may be made during the practice of the invention without departing from the contemplated scope. For example, while the bundling tie has been described herein as preferably made of stainless steel for particular use in harsh environments, it should be understood that other materials having suitable strength and capacity for wear and tolerance in such harsh environments may also be used. Furthermore, while in the preferred embodiment of the bundling tie a strap and head are separably attached so that strap lengths may be provided to suit the users particular dimensions, it should be understood that a strap of fixed length may be provided with the strap and head securely fixed upon manufacture. Accordingly, the embodiments described herein are intended in an illustrative rather than a limiting sense, the true scope of the invention being set forth in the claims appended hereto.

I claim:

1. A self-locking bundling tie for engagement about an article comprising:

a flexible elongate strap having two opposing longitudinal ends; and a head attached to said strap adjacent one end thereof, said head including a housing and a locking insert supported by said housing and movable relative thereto, said housing and said locking insert including cooperative latching means for holding said insert fixed in at least two position relative to said housing, said insert in a first position having an opening for receipt of the unattached end of said strap therethrough, said housing and said insert having means that upon movement of said insert to a second position cooperate to engage and bend a portion of said strap extending through said opening in a manner capturing said bent strap portion in a locked position relative to said head.

2. A bundling tie according to claim 1, wherein said housing comprises a hollow member having walls defining a cavity therein, said insert extending within said cavity.

3. A bundling tie according to claim 2, wherein said insert comprises a generally planar member slidably received within said cavity, said insert opening when said insert is in said first position being exteriorly of said cavity and said insert opening when said insert is in said second position being in said cavity within said housing walls.

4. A bundling tie according to claim 3, wherein said cooperative latching means comprises a barb extending from a surface of said insert and at least two spaced recesses in the housing walls adapted for engagement with said recesses, said barb being configured to permit movement of said insert into said cavity and preventing withdrawal of said insert from said cavity.

5. A bundling tie according to claim 4, wherein said strap, said housing and said insert are metallic.

6. A bundling tie according to claim 5, wherein the material of each of said strap, said housing and said insert is stainless steel.

7. A bundling tie according to claim 5, wherein said head and said strap are separably attached.

8. A bundling tie according to claim 7, wherein said housing head comprises a crimpable member receiving a portion of strap attached to said head.

9. A bundling tie according to claim 8, wherein said crimpable member comprises a pair of facing deformable arms, each of which deformably engage a portion of said strap, providing thereby said attachment of said strap to said head.

10. A self-locking bundling tie for engagement about an article comprising:

a flexible, elongate, metallic strap having two opposing longitudinal ends; and a head attached to said strap adjacent one end thereof, said head including a metallic housing and a metallic locking insert, said housing having walls defining a cavity within which said locking insert is slidably received, said cavity extending fully through said housing, said insert having an opening for receipt therethrough of the unattached end of said strap, said housing including latching means for fixedly holding said insert in at least two positions relative to said housing, said insert opening in a first fixed position of said insert being disposed exteriorly of said housing to freely receive said unattached end of said strap end therethrough and said insert opening in a second fixed position of said insert being disposed in said housing cavity within the housing walls, whereby the unattached end of said strap extending through said insert opening is locked therein, said locking insert being generally planar and including a latching barb extending from one of its surfaces, said latching means on said housing including spaced recesses in the walls of said housing adapted for retentive receipt therein of said barb.

11. A bundling tie according to claim 10, wherein a portion of said strap extends into said cavity from a direction opposite said insert, said strap portion extending foldably back against the exterior walls of said housing.

12. A bundling tie according to claim 11, wherein said housing comprises a crimpable member engaging said folded back portion of said strap, thereby providing said attachment of said strap to said head.

13. A bundling tie according to claim 10, wherein said housing has three recesses spaced therein.

14. A method of bundling articles, comprising the steps of:

providing a bundling tie comprising a flexible, elongate, metallic strap having two opposed longitudinal ends and a head attached to one end of said strap, said head including a metallic housing having a cavity therein and a metallic insert having two opposed surfaces slidably received in said cavity, said head having latching means for fixedly holding said insert in at least two positions relative to said housing, said insert having an opening extending through said opposing surfaces for free receipt therethrough of the unattached end of said strap when said insert is in a first position, encircling said articles with said strap and placing said unattached end of said strap through said opening in said insert such that a length of said strap end projects through said opening adjacent one surface of said insert; and sliding said insert into said housing cavity to a second position such that said insert opening with said strap end therethrough moves into said cavity within said housing, said length of strap adjacent said one insert surface being engaged by said housing upon sliding movement of said insert into said cavity and deformably folded therey in a manner extending reversely from a portion of strap lying adjacent said opposity insert surface within said cavity.

15. A method according to claim 14, wherein said length of strap is obtained by cutting said unattached strap end a predetermined distance from said insert opening, defining thereby a cut end of said strap.

16. A method according to claim 15, wherein upon sliding said insert within said cavity said cut end of said strap is disposed closely adjacent said housing.

17. A method according to claim 15, wherein said length of strap is cut to such a predetermined distance so that upon sliding said insert into said cavity said cut end is disposed in said cavity within said housing.

* * * * *